US007720241B2

(12) United States Patent
Okimoto et al.

(10) Patent No.: US 7,720,241 B2
(45) Date of Patent: May 18, 2010

(54) SOUND IMAGE LOCALIZATION APPARATUS AND METHOD AND RECORDING MEDIUM

(75) Inventors: Koyuru Okimoto, Tokyo (JP); Yuji Yamada, Tokyo (JP)

(73) Assignee: Sony Corporation (JP)

( * ) Notice: Subject to any disclaimer, the term of this patent is extended or adjusted under 35 U.S.C. 154(b) by 1230 days.

(21) Appl. No.: 11/128,532

(22) Filed: May 13, 2005

(65) Prior Publication Data

US 2005/0265557 A1 Dec. 1, 2005

(30) Foreign Application Priority Data

May 31, 2004 (JP) ..... P2004-162322

(51) Int. Cl.
*H04R 5/02* (2006.01)

(52) U.S. Cl. ..... 381/310; 381/17; 381/309

(58) Field of Classification Search ..... 381/1, 381/17–18, 309–310, 74, 61, 98
See application file for complete search history.

(56) References Cited

U.S. PATENT DOCUMENTS

| | | | | |
|---|---|---|---|---|
| 5,761,315 | A * | 6/1998 | Iida et al. | 381/18 |
| 6,285,766 | B1 * | 9/2001 | Kumamoto | 381/17 |
| 6,947,569 | B2 * | 9/2005 | Yamada et al. | 381/310 |
| 7,043,036 | B2 * | 5/2006 | Yamada et al. | 381/309 |
| 2003/0215104 | A1 * | 11/2003 | Yamada et al. | 381/309 |

FOREIGN PATENT DOCUMENTS

| | | |
|---|---|---|
| JP | 07-095697 | 4/1995 |
| JP | 07-184299 | 7/1995 |
| JP | 09-028000 | 1/1997 |
| JP | 09-037399 A | 2/1997 |
| JP | 10-042400 | 2/1998 |
| JP | 2000-059899 A | 2/2000 |
| JP | 2001-186600 | 7/2001 |
| JP | 2003-274493 | 9/2003 |

* cited by examiner

*Primary Examiner*—Xu Mei
*Assistant Examiner*—Disler Paul
(74) *Attorney, Agent, or Firm*—Lerner, David, Littenberg, Krumholz & Mentlik, LLP

(57) ABSTRACT

A sound image localization apparatus for localizing a reproduced sound image at a sound source position convolves an impulse response through each path from an optimal position of localization of a sound source to the left and right ears of the listener into an audio signal to generate an audio signal for localization on the left and right channels. The impulse response is convolved after down sampling the audio signal localized to the position of the sound source behind the listener and thereby the amount of operation required of a signal processor for convoluting the impulse response is greatly reduced without spoiling a spatial localization of the sound image.

6 Claims, 12 Drawing Sheets

SOUND IMAGE LOCALIZATION APPARATUS AND METHOD AND RECORDING MEDIUM

CROSS REFERENCES TO RELATED APPLICATIONS

The present invention contains subject matter related to Japanese Patent Application JP2004-162322 filed in the Japanese Patent Office on May 31, 2005, the entire contents of which being incorporated herein by reference.

BACKGROUND OF THE INVENTION

1. Field of the Invention

The present invention relates to a sound image localization apparatus, and is suitably applicable to a sound image localization apparatus for localizing a sound image reproduced by a headphone to an optimal position.

2. Description of the Related Art

Multi-channel audio signals are abundantly used as the sound along with the picture such as a movie. It is presumed that such multi-channel audio signals to be recorded are regenerated with the speaker arranged to both sides of the graphic display plane such as a screen and in the center, and the speaker put on the back of the listener or both sides. A sound field to have a natural broadening for the sound image position of regenerated sound actually heard to be like the position of a sound source in the picture can be established by regenerating those audio signals using a set of speakers arranged to such fixed positions.

However, when such an audio signal is reproduced on a headphone apparatus, the sound image of the regenerated sound is localized in the head of the listener. Because of this, the position of a sound image of the regenerated sound does not align with the position of a sound source in the picture, giving rise to a very unnatural sound field. Also, the position of localization of the audio signal of each channel can not regenerate separately and independently, and therefore more than one musical sound like an orchestra is localized uniformly in the head to compose an unnatural sound field.

To improve unnatural localization of the sound image in such headphone apparatus, a headphone apparatus was proposed in which an impulse response from an optimal position of a speaker to both ears of the listener is measured or calculated, an impulse response concerned is convolved in the audio signal using the digital filter, and the audio signal is regenerated, thereby attaining auditory localization of the natural sound image which just regenerates from the actual speaker (e.g., refer to Japanese Patent Application Laid-Open No. 2000-227350).

FIG. 1 shows the configuration of a headphone apparatus 100 for auditorily localizing the sound image of audio signal on one channel. The headphone apparatus 100 converts an analog audio signal SA on one channel inputted via an input terminal 1 into digital form in an analog digital conversion circuit 2 to generate a digital audio signal SD, and supply it to the digital processing circuits 3L and 3R. The digital processing circuits 3L and 3R perform the signal processings of auditory localization for the digital audio signal SD.

When a sound source SP to be localized is in front of the listener M, as shown in FIG. 2, the sound outputted from the sound source SP arrives via a path having the transfer functions HL and HR to the left and right ears of the listener M. The impulse responses on the left and right channels in which the transfer functions HL and HR are transformed into the time axis are measured or calculated in advance.

The digital processing circuits 3L and 3R convolve the impulse responses on the left and right channels into the digital audio signal SD and output the digital audio signals SDL and SDR. In this connection, each of the digital processing circuits 3L and 3R is made up of a Finite Impulse Response (FIR) filter, as shown in FIG. 3.

The digital analog conversion circuits 4L and 4R convert the digital audio signals SDL and SDR into analog form to generate the analog audio signals SAL and SAR, which are amplified in the corresponding amplifiers 5L and 5R, and supplied to a headphone 6. And the acoustic units (electro-acoustic transducer elements) 6L and 6R of the headphone 6 convert the analog audio signals SAL and SAR into sound and output it.

Accordingly, the left and right reproduced sounds outputted from the headphone 6 become equivalent to the sounds arriving from the sound source SP via the path having the transfer functions HL and HR, as shown in FIG. 2. Thereby, when the listener wears the headphone 6 and listens to the reproduced sound, the sound image is localized at the position of the sound source SP as shown in FIG. 2 (i.e., auditory localization).

Referring to FIG. 4, a headphone apparatus 101 for localizing the sound image of a multi-channel audio signal out of the head will be described below. In this headphone apparatus 101, the audio signals on three channels are localized out of the head to the positions corresponding to the sound sources SPa, SPb and SPc, as shown in FIG. 5. The impulse responses in which the transfer functions HaL and HaR from a sound source SPa to both ears of the listener M, the transfer functions HbL and HbR from a sound source SPb to both ears of the listener M, and the transfer functions HcL and HcR from a sound source SPc to both ears of the listener M are transformed into the time axis are measured or calculated in advance.

In FIG. 4, an analog digital conversion circuit 2*a* of the headphone apparatus 101 converts an analog audio signal SAa inputted via an input terminal 1*a* into digital form to generate a digital audio signal SDa, which is supplied to the digital processing circuits 3*a*L and 3*a*R at the latter stage. Likewise, an analog digital conversion circuit 2*b* converts an analog audio signal SAb inputted via an input terminal 1*b* into digital form to generate a digital audio signal SDb, which is supplied to the digital processing circuits 3*b*L and 3*b*R at the latter stage. Also, an analog digital conversion circuit 2*c* converts an analog audio signal SAc inputted via an input terminal 1*c* into digital form to generate a digital audio signal SDc, which is supplied to the digital processing circuits 3*c*L and 3*c*R at the latter stage.

The digital processing circuits 3*a*L, 3*b*L and 3*c*L convolve an impulse response for the left ear into the digital audio signals SDa, SDb and SDc, and supply the digital audio signals SDaL, SDbL and SDcL to an addition circuit 7L. Likewise, the digital processing circuits 3*a*R, 3*b*R and 3*c*R convolve an impulse response for the right ear into the digital audio signals SDa, SDb and SDc, and supply the digital audio signals SDaR, SDbR and SDcR to an addition circuit 7R. Each of the digital processing circuits 3*a*L and 3*a*R, 3*b*L and 3*b*R, 3*c*L and 3*c*R is made up of the same FIR filter as the digital processing circuits 3L and 3R, as shown in FIG. 1.

The addition circuit 7L adds the digital audio signals SDaL, SDbL and SDcL, into which the impulse response is convolved, to generate a digital audio signal SDL on the left channel. Likewise, the addition circuit 7R adds the digital audio signals SDaR, SDbR and SDcR, into which the impulse response is convolved, to generate a digital audio signal SDR on the right channel.

The digital analog conversion circuits 4L and 4R convert the digital audio signals SDL and SDR into analog form to generate the analog audio signals SAL and SAR, which are amplified by the corresponding amplifiers 5L and 5R, and supplied to the headphone 6. And the acoustic units 6L and 6R of the headphone 6 convert the analog audio signals SAL and SAR into sound and output it.

At this time, the left and right reproduced sounds outputted from the headphone 6 become equivalent to the sounds arriving from the sound sources SPa, SPb and SPc via the paths having the transfer functions HaL and HaR, HbL and HbR, HcL and HcR, as shown in FIG. 5. Thereby, when the listener wears the headphone 6 and listens to the reproduced sounds, the sound images are localized at the positions of the sound sources SPa, SPb and SPc, as shown in FIG. 5. When the audio signals on four or more channels are dealt with, the sound image is auditorily localized in same way.

On the other hand, when the multi-channel audio signal is regenerated on the speakers, there is a problem that a number of speakers corresponding to channels may not be arranged due to the limited area of a listening room. According to an embodiment, there is an attempt for composing a number of sound images around the listener, employing a limited number of speakers.

FIG. 6 shows a speaker apparatus 200 for localizing the sound image at any position, employing two speakers 9L and 9R, in which an analog audio signal SA inputted via an input terminal 1 is converted into digital form by an analog digital conversion circuit 2 to generate a digital audio signal SD which is supplied to the digital processing circuits 8L and 8R.

The digital processing circuits 8L and 8R convolve an impulse response (hereinafter described) for localizing the sound image into the digital audio signal SD and output the digital audio signals SDL and SDR. Each of the digital processing circuits 8L and 8R is made up of the same FIR filter as the digital processing circuits 3L and 3R as shown in FIG. 1.

The digital analog conversion circuits 4L and 4R convert the digital audio signals SDL and SDR into analog form to generate the analog audio signals SAL and SAR, which are amplified by the corresponding amplifiers 5L and 5R, and supplied to the speakers 9L and 9R. And the speakers 9L and 9R convert the analog audio signals SAL and SAR into sound and output it.

The concept of a sound image localization process in the digital processing circuits 8L and 8R will be described below. A case where the sound sources SPL and SPR are disposed left and right forward of the listener M, and a virtual sound source SPx is equivalently revived (localized) at any position by the sound sources SPL and SPR will be considered, as shown in FIG. 7.

Herein, supposing the transfer functions

HLL: transfer function from sound source SPL to the left ear of the listener M

HLR: transfer function from sound source SPL to the right ear of the listener M

HRL: transfer function from sound source SPR to the left ear of the listener M

HRR: transfer function from sound source SPR to the right ear of the listener M

HXL: transfer function from virtual sound source SPX to the left ear of the listener M HXR: transfer function from virtual sound source SPX to the right ear of the listener M the sound sources SPL and SPR are given by the following expression.

$$SPL=(HXL\times HRR-HXR\times HRL)/(HLL\times HRR-HLR\times HRL)\times SPX \quad (1)$$

$$SPR=(HXR\times HLL-HXL\times HLR)/(HLL\times HRR-HLR\times HRL)\times SPX \quad (2)$$

Accordingly, the digital processing circuits 8L and 8R convolve an impulse response in which the transfer functions as in the expression (1) or (2) are transformed into the time axis into the digital audio signal SD to localize the sound image at the position of the virtual sound source SPx.

Though in the above description, the sound of audio signal on one channel is localized at any position by two speakers 9L and 9R, the sound of each of multi-channel audio signals may be localized at any position by two speakers, employing the same configuration as the multi-channel headphone apparatus 101, as shown in FIG. 4.

In the above headphone apparatus or speaker apparatus, the sound image is localized at any position by convoluting an impulse response based on the transfer function into the audio signal. However, when each of multi-channel audio signals is regenerated as the sound image having a clear spatial localization at any position, it may be required to convolve the impulse response having a sufficient length for each sound source, causing a problem that the digital processing circuit has an enormous amount of operation, making the configuration of the apparatus complex.

Therefore, there has been a need for a sound image localization apparatus which realizes localization of the sound image with a significantly reduced amount of operation.

SUMMARY OF THE INVENTION

The present invention provides a sound image localization apparatus for localizing a reproduced sound image to the position of localization of a sound source by generating an audio signal for localization on left and right channels, based on an impulse response from the position of localization of the sound source to the left and right ears of the listener, including a sampling rate change means for down sampling a rear audio signal localized to a position of localization of the sound source behind the listener, and a signal processing means for performing the signal processing for the rear audio signal down sampled by the sampling rate change means, based on the impulse response from the position of localization of the sound source behind the listener to the left and right ears of the listener, and generating the audio signal for localization.

The signal processing is performed based on the impulse response after down sampling the audio signal localized to the position of localization of the sound source behind the listener, whereby the amount of operation in the signal processing means can be reduced without spoiling the spatial localization of the sound image.

Also, in the invention, the sound source localization apparatus is provided with rear audio signal generation means for generating a rear audio signal from the input audio signal.

Moreover, the signal processing means performs the signal processing for the rear audio signal after down sampling based on the impulse response from the first position of localization of a sound source behind the listener to the left and right ears of the listener to generate a first audio signal for localization where the sound image is localized at the first position of localization of sound source, and generate a second audio signal for localization where the sound image is localized at the second position of localization of a sound source that is in contrast to the first position of localization of the sound source via the median plane of listener head by inverting the first audio signal for localization.

Thereby, the amount of operation in the signal processing means can be remarkably reduced.

With this invention, the amount of operation in localizing the sound image behind the listener can be greatly reduced to have a simpler configuration of the sound image localization apparatus.

The nature, principle and utility of the invention will become more apparent from the following detailed description when read in conjunction with the accompanying drawings in which like parts are designated by like reference numerals or characters.

DETAILED DESCRIPTION OF THE PREFERRED EMBODIMENTS

The preferred embodiments of the invention will be described below in detail with reference to the drawings.

(1) First Embodiment

(1-1) Overall Configuration of Headphone Apparatus

Figure 1:
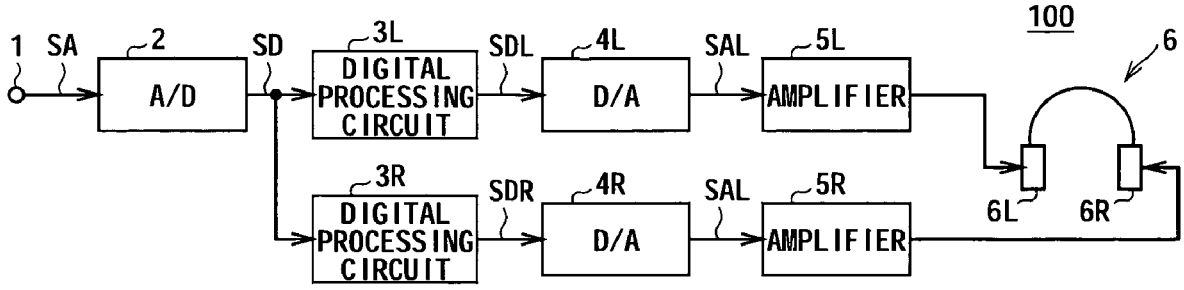
FIG.1(RELATED ART)
FIG. 1 is a block diagram showing the overall configuration of a conventional headphone apparatus.
Figure 2:
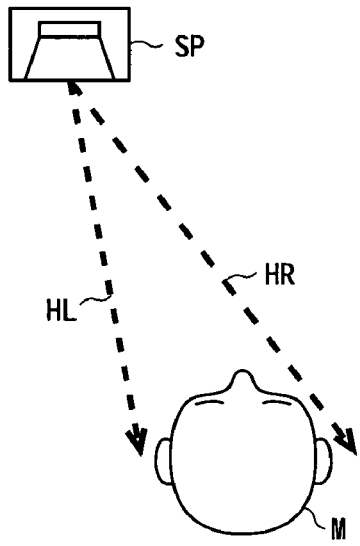
FIG.2(RELATED ART)
FIG. 2 is a diagrammatic view for explaining the localization of sound image in the headphone apparatus.
Figure 3:
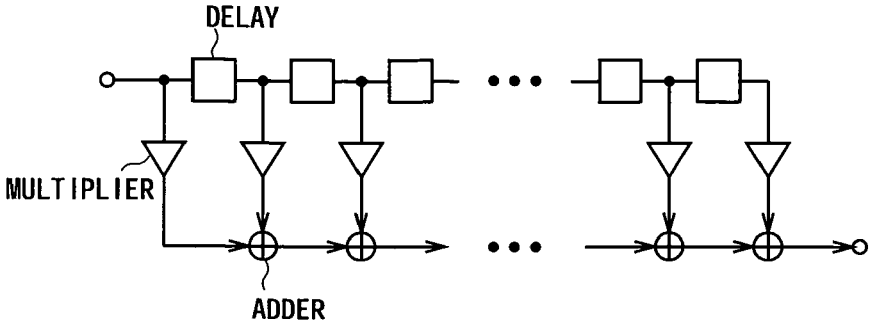
FIG.3(RELATED ART)
FIG. 3 is a block diagram showing the configuration of an FIR filter.
Figure 4:
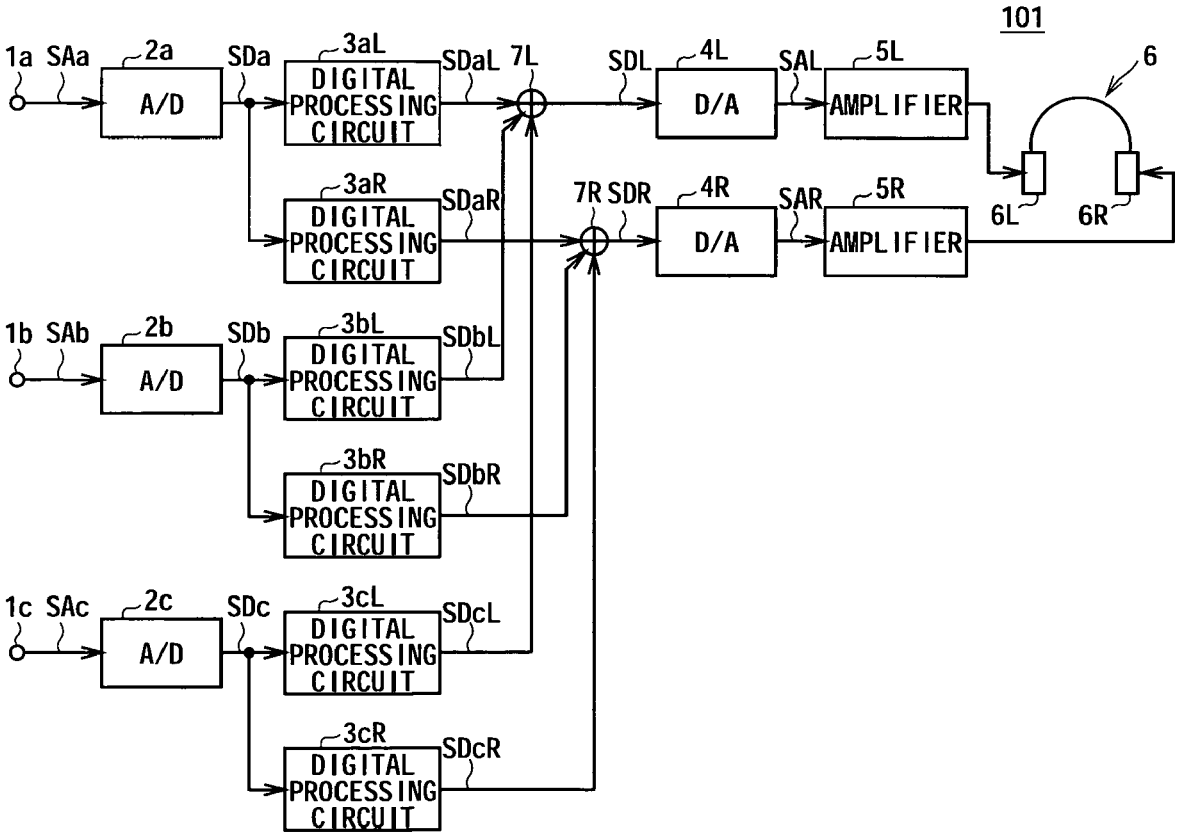
FIG.4(RELATED ART)
FIG. 4 is a block diagram showing the configuration of a multi-channel headphone apparatus.
Figure 5:
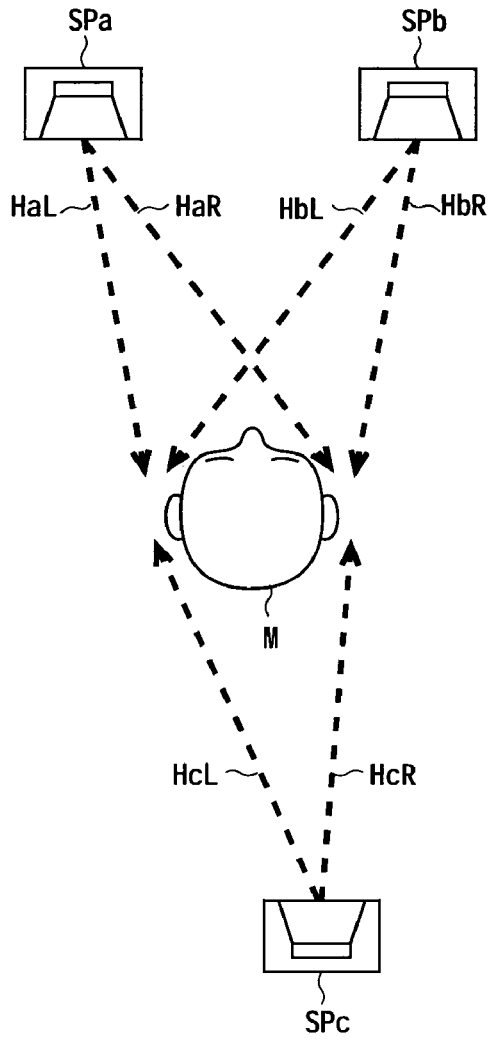
FIG.5(RELATED ART)
FIG. 5 is a diagrammatic view for explaining the transfer functions for multi-channel.
Figure 8:
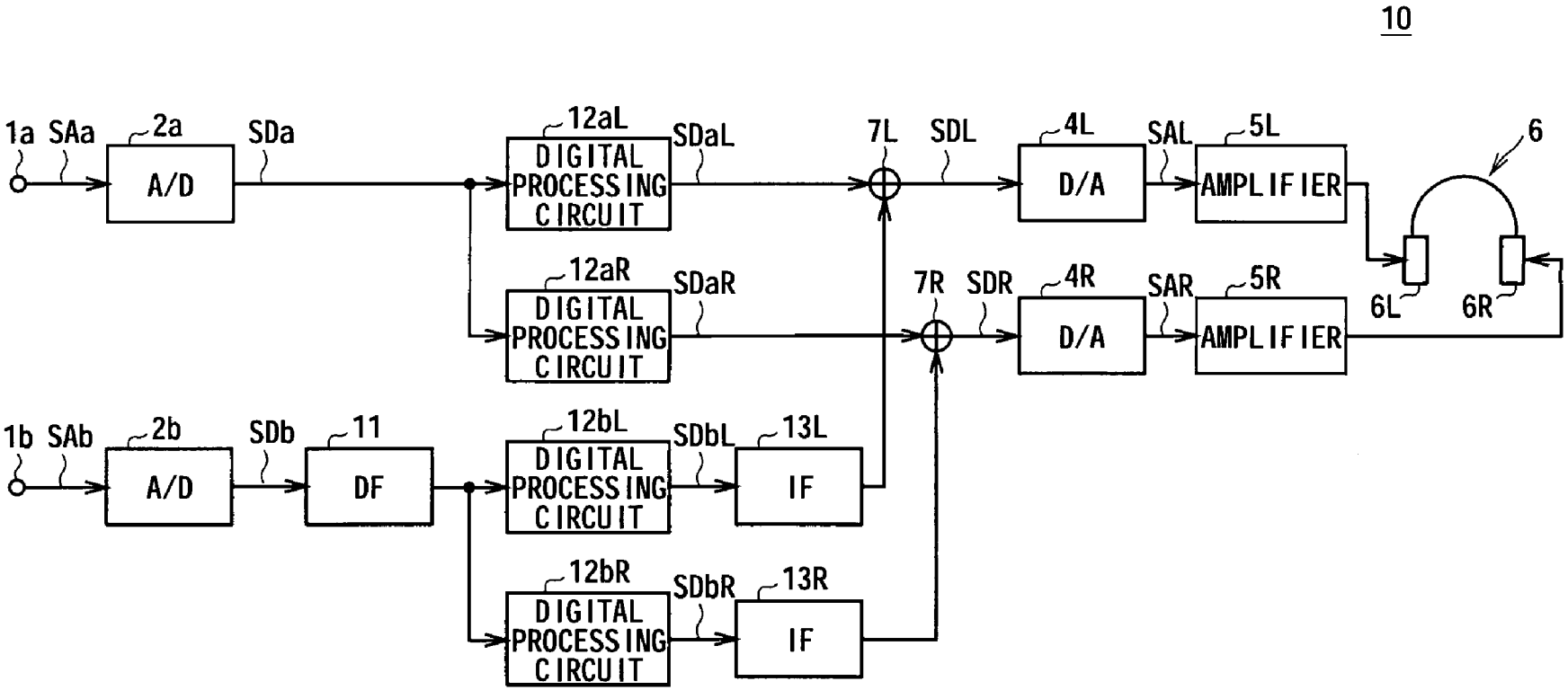
FIG. 8 is a block diagram showing the overall configuration of a headphone apparatus according to a first embodiment of the present invention.
Figure 9:
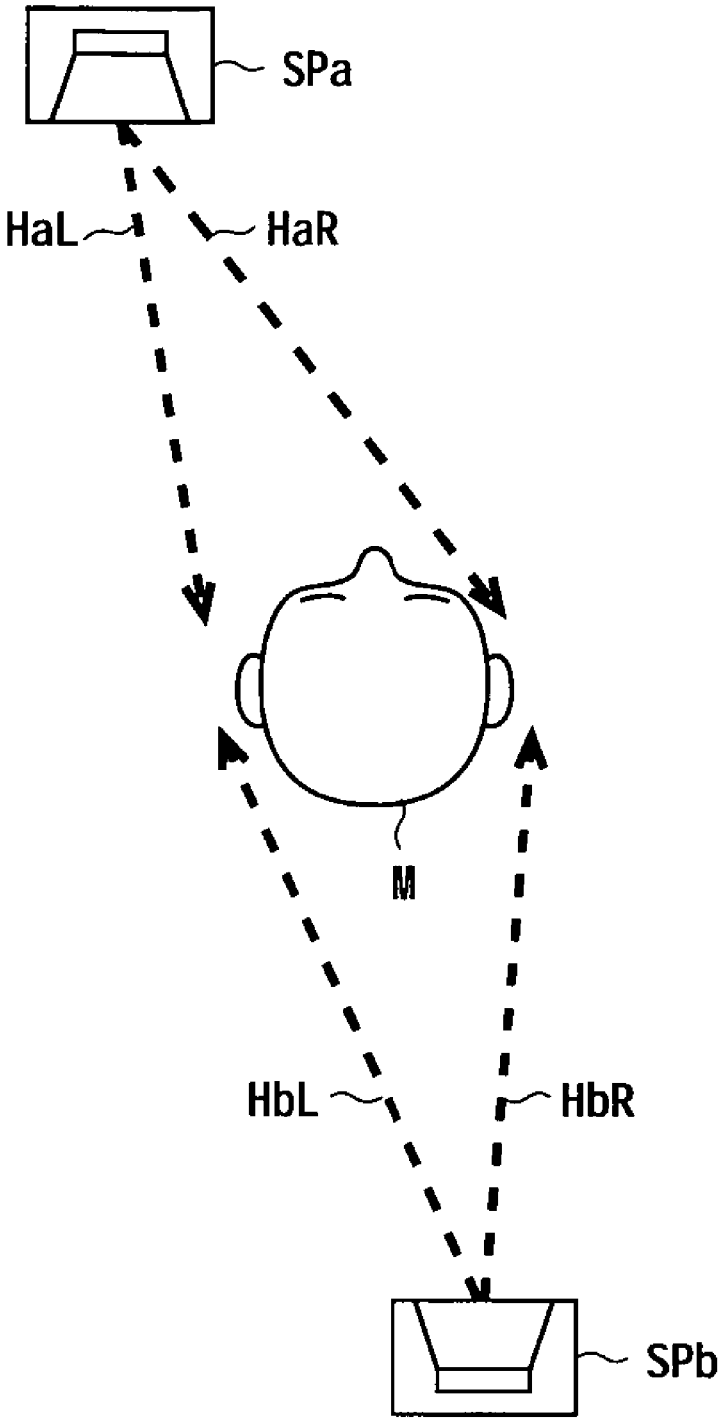
FIG. 9 is a diagrammatic view for explaining a localization of sound image in the first embodiment.

In FIG. 8, wherein the common parts to those of FIGS. 1 and 4 are designated by the same signs, reference numeral 10 designates a headphone apparatus as a sound image localization apparatus according to a first embodiment of the invention. In FIG. 8, the input audio signals SAa and SAb on two channels are auditorily localized at the positions of the sound sources SPa and SPb, as shown in FIG. 9. The impulse responses in which the transfer functions HaL and HaR from a sound source SPa to both ears of the listener M and the transfer functions HbL and HbR from a sound source SPb to both ears of the listener M are transformed into the time axis are measured or calculated in advance.

Figure 10A:
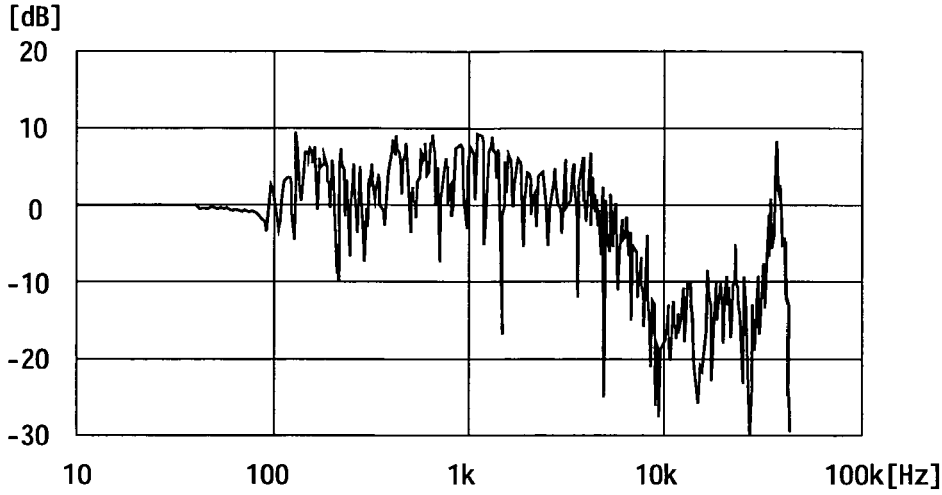
FIGS. 10A and 10B are characteristic charts of the transfer frequency characteristic.
Figure 10B:
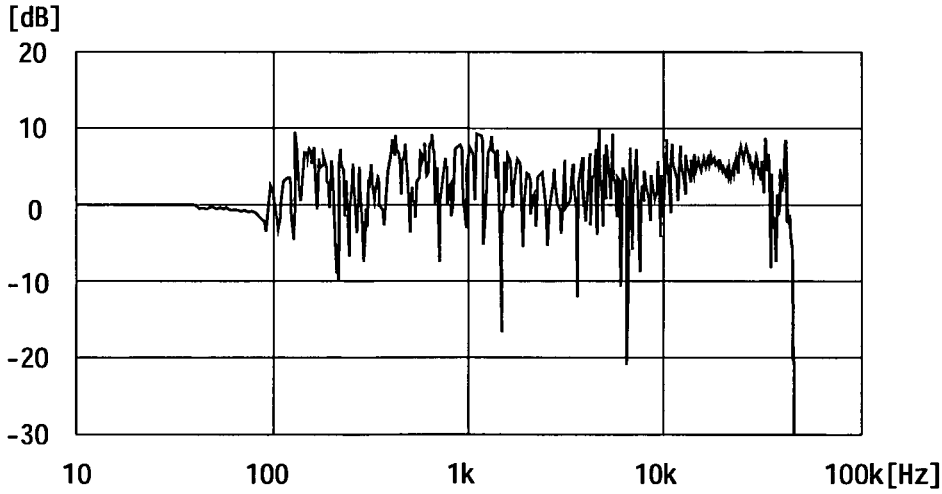

It is known that the transfer frequency characteristic (FIG. 10A) from backward to the ears of the person is inferior in the high frequency region to the transfer frequency characteristic (FIG. 10B) from forward to the ears of the person under the influence of a head part or concha (i.e., the sound from behind is degraded in the high frequency characteristic). Thereby, the impulse response for backward localization can be cut on the high frequency component, as compared with the impulse response for forward localization.

In view of this, the headphone apparatus 10 operates the digital processing circuits 12*b*L and 12*b*R for performing the processing for backward localization at a lower sampling rate than the digital processing circuits 12*a*L and 12*a*R for performing the processing for forward localization.

That is, in FIG. 8, an analog digital conversion circuit 2*a* of the headphone apparatus 10 as sound image localization apparatus converts an analog audio signal SAa inputted via an input terminal 1*a* into digital form at a predetermined sampling rate to generate a digital audio signal SDa, which is supplied to the digital processing circuits 12*a*L and 12*a*R for forward localization.

A digital processing circuit 12*a*L convolves an impulse response in which a transfer function HaL (FIG. 9) from the sound source SPa to the left ear of the listener M is transformed into the time axis into the digital audio signal SDa, and supplies a digital audio signal SDaL to an addition circuit 7L for left channel. Likewise, a digital processing circuit 12*a*R convolves an impulse response in which a transfer function HaR from the sound source SPa to the right ear of the listener M is transformed into the time axis into the digital audio signal SDa, and supplies a digital audio signal SDaR to an addition circuit 7R for right channel.

On the contrary, an analog digital conversion circuit 2*b* converts an analog audio signal SAb inputted via an input terminal 1*b* into digital form at the same sampling rate as the analog digital conversion circuit 2*a* to generate a digital audio signal SDb, which is supplied to a decimation filter 11. The decimation filter 11 as sampling rate change means performs the down sampling for the digital audio signal SDb at 1/n the sampling rate (n is an integer of 2 or greater), and supplies down sampled signals to the digital processing circuits 12*b*L and 12*b*R for backward localization.

A digital processing circuit 12*b*L as signal processing means convolves an impulse response in which a transfer function HbL (FIG. 9) from the sound source SPb to the left ear of the listener M is transformed into the time axis into the digital audio signal SDb, and supplies a digital audio signal SDbL to an interpolation filter 13L. The interpolation filter 13L makes the up sampling for the digital audio signal SDbL at n times the sampling rate to restore the same sampling rate of the original digital audio signal SDb, and supplies up-sampled signals to the addition circuit 7L for left channel.

Likewise, a digital processing circuit 12*b*R as signal processing means convolves an impulse response in which a transfer function HbR from the sound source SPb to the right ear of the listener M is transformed into the time axis into the digital audio signal SDb, and supplies a digital audio signal SDbR to an interpolation filter 13R. The interpolation filter 13R makes the up sampling for the digital audio signal SDbR at n times the sampling rate to restore the same sampling rate of the original digital audio signal SDb, and supplies up-sampled sampled signals to the addition circuit 7R for right channel.

The addition circuit 7L adds the digital audio signals SDaL and SDbL to generate a digital audio signal SDL on the left channel. Likewise, the addition circuit 7R adds the digital audio signals SDaR and SDbR to generate a digital audio signal SDR on the right channel.

The digital analog conversion circuits 4L and 4R convert the digital audio signals SDL and SDR into analog form to generate the analog audio signals SAL and SAR, which are amplified by the corresponding amplifiers 5L and 5R, and supplied to the headphone 6. And the acoustic units 6L and 6R of the headphone 6 convert the analog audio signals SAL and SAR into sound and output it.

At this time, the left and right reproduced sounds outputted from the headphone 6 compose the almost same sound field as when the analog audio signals SAa and SAb are supplied to the speakers placed at the positions of the sound sources SPa and SPb (FIG. 9), in which the sound image of reproduced sound is localized out of the head of the listener M.

(1-2) Reducing the Amount of Operation in the Headphone Apparatus

Figure 11:
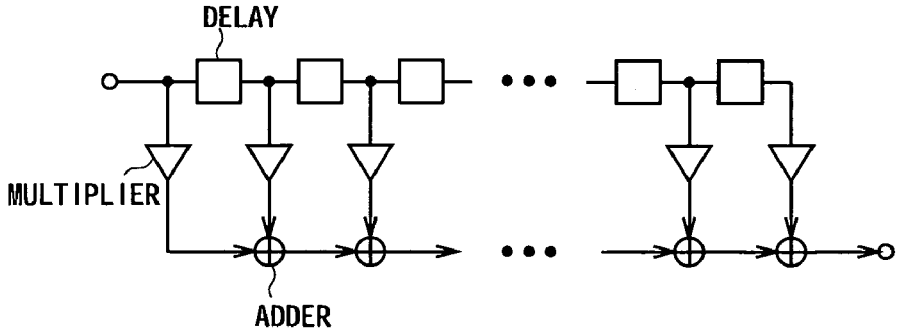
FIG. 11 is a block diagram showing the configuration of an FIR filter.

Each of the digital processing circuits 12*b*L, 12*b*R, 12*a*L and 12*a*R is made up of an FIR filter as shown in FIG. 11. The digital processing circuits 12*b*L and 12*b*R for backward localization operate at 1/n the sampling rate of the digital processing circuits 12*a*L and 12*a*R for forward localization.

Taking n=2, for example, and supposing that the number of taps in the digital processing circuits 12*b*L and 12*b*R is T, the digital processing circuits 12*b*L and 12*b*R perform the convolution operation for 2T (=2×T) taps per two samples of the digital audio signal SDb, and thereby the convolution operation for T taps per sample. On the contrary, if no down sampling is performed, the number of taps in the digital processing circuits 12*b*L and 12*b*R is doubled or 2T, and the digital processing circuits 12*b*L and 12*b*R make the convolution operation for 4T (=2×2T) taps per sample of the digital audio signal SDb.

In this manner, the headphone apparatus 10 operates the digital processing circuits 12*b*L and 12*b*R for backward localization at 1/n the sampling rate, and reduces the amount of operation into $1/n^2$ as compared with when no down sampling is performed.

Herein, to enable the digital processing circuits 12*b*L and 12*b*R to operate at a low sampling rate, the decimation filter 11 for down sampling and the interpolation filters 13L, 13R for up sampling may be required as above, so that the amount of operation in the headphone apparatus 10 is correspondingly increased.

Figure 12:
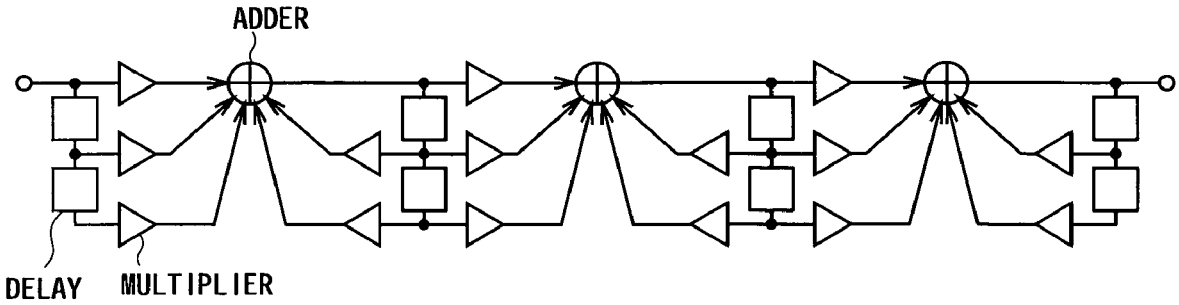
FIG. 12 is a block diagram showing the configuration of an IIR filter.

In practice, each of the decimation filter 11 and the interpolation filters 13L, 13R can be made up of an Infinite Impulse Response (IIR) filter as shown in FIG. 12. And the decimation filter 11 and the interpolation filters 13L, 13R operate with only a smaller amount of operation ignorably than the digital processing circuits 12*a*L, 12*a*R, 12*b*L and 12*b*R of the FIR filter for convoluting the impulse response having a sufficient length. Thereby, the headphone apparatus 10 greatly reduces the amount of operation over the entire apparatus.

With the above configuration, the digital processing circuits 12*b*L and 12*b*R for backward localization is operated at 1/n the sampling rate, whereby the configuration of the headphone apparatus 10 is simplified by reducing the amount of operation without spoiling the spatial localization of the sound image.

(2) Second Embodiment (2-1) Overall Configuration of Headphone Apparatus

Figure 13:
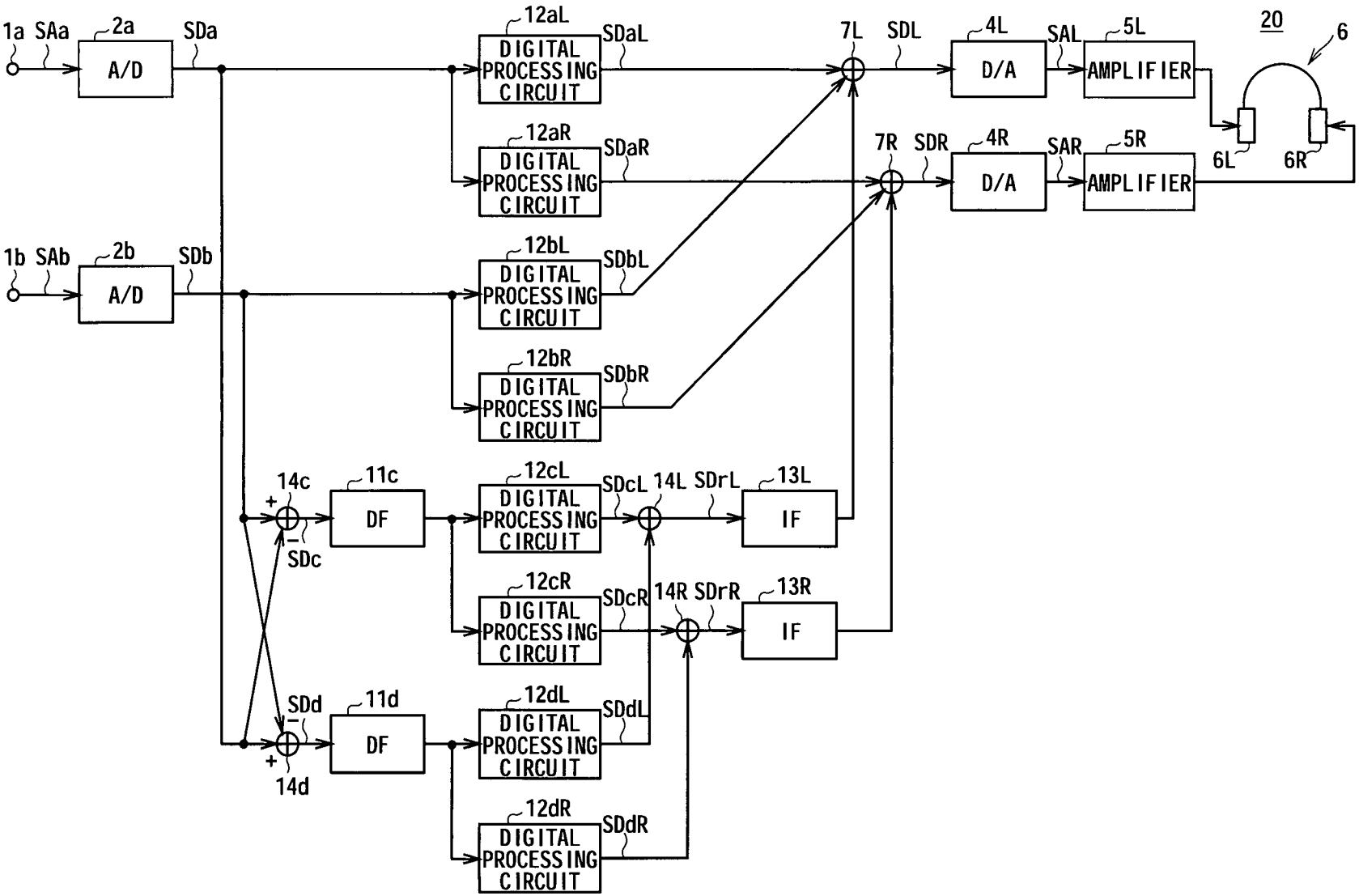
FIG. 13 is a block diagram showing the overall configuration of a headphone apparatus according to a second embodiment of the invention.
Figure 14:
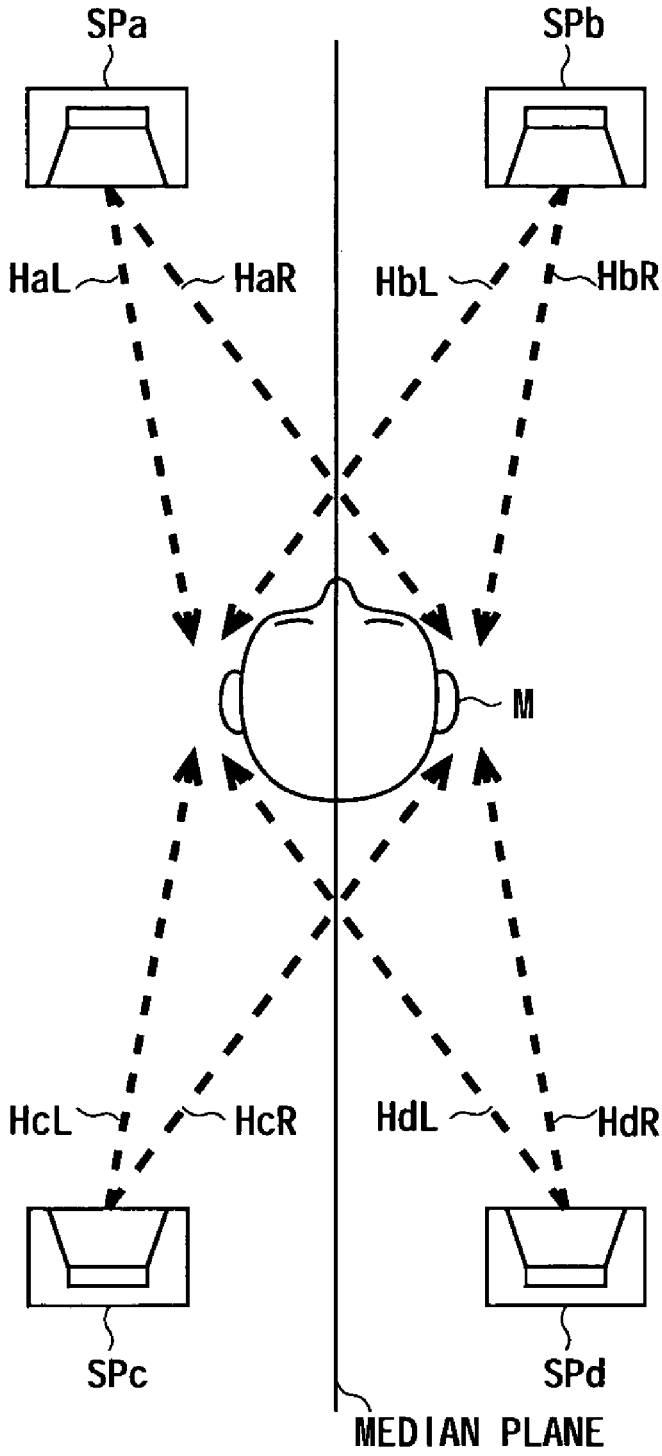
FIG. 14 is a diagrammatic view for explaining the localization of sound image in the second embodiment.

In FIG. 13, wherein the common parts to those of FIG. 8 are designated by the same signs, reference numeral 20 designates a headphone apparatus as a sound image localization apparatus according to a second embodiment of the invention. The input audio signals SAa and SAb on two channels are auditorily localized at the positions of the sound sources SPa and SPb to the left and right forward of the listener M, as shown in FIG. 14. The audio signals SAc and SAd for backward localization are generated from the audio signals SAa and SAb, and auditorily localized at the positions of the sound sources SPc and SPd to the left and right backward of the listener M. The impulse responses in which the transfer functions HaL and HaR from a sound source SPa to both ears of the listener M, the transfer functions HbL and HbR from a sound source SPb to both ears of the listener M, the transfer functions HcL and HcR from a sound source SPc to both ears of the listener M and the transfer functions HdL and HdR from a sound source SPd to both ears of the listener M are transformed into the time axis are measured or calculated in advance.

Herein, the headphone apparatus 20, like the headphone apparatus 10, operates the digital processing circuits 12*c*L, 12*c*R, 12*d*L and 12*d*R for performing the processing for the audio signals SAc and SAd for backward localization at a lower sampling rate than the digital processing circuits 12*a*L, 12*a*R, 12*b*L and 12*b*R for performing the processing for forward localization, thereby reducing the amount of operation over the entire apparatus.

That is, the analog digital conversion circuit 2*a* of the headphone apparatus 20 as the sound image localization apparatus converts an analog audio signal SAa inputted via the input terminal 1*a* into digital form to generate a digital audio signal SDa, which is supplied to the digital processing circuits 12*a*L and 12*a*R and the addition circuits 14*c* and 14*d*. A digital processing circuit 12*a*L convolves an impulse response in which a transfer function HaL (FIG. 14) from the sound source Spa to the left ear of the listener M is transformed into the time axis into the digital audio signal SDa, and supplies a digital audio signal SDaL to the addition circuit 7L for left channel. Likewise, a digital processing circuit 12*a*R convolves an impulse response in which a transfer function HaR from the sound source SPa to the right ear of the listener M is transformed into the time axis into the digital audio signal SDa, and supplies a digital audio signal SDaR to the addition circuit 7R for right channel.

Also, the analog digital conversion circuit 2*b* converts an analog audio signal SAb inputted via the input terminal 1*b* into digital form to generate a digital audio signal SDb, which is supplied to the digital processing circuits 12*b*L and 12*b*R, and the addition circuits 14*c* and 14*d*. A digital processing circuit 12*b*L convolves an impulse response in which a transfer function HbL from the sound source SPb to the left ear of the listener M is transformed into the time axis into the digital audio signal SDb, and supplies a digital audio signal SDbL to the addition circuit 7L for left channel. Likewise, a digital processing circuit 12*b*R convolves an impulse response in which a transfer function HbR from the sound source SPb to the right ear of the listener M is transformed into the time axis into the digital audio signal SDb, and supplies a digital audio signal SDbR to the addition circuit 7R for right channel.

An addition circuit 14*c* subtracts the digital audio signal SDa from the digital audio signal SDb to generate a digital audio signal SDc for localization to the sound source SPc left backward as shown in FIG. 14, and supplies it to a decimation filter 11$c$. The decimation filter 11$c$ as sampling rate change means performs the down sampling for the digital audio signal SDc at 1/n the sampling rate (n is an integer of 2 or greater), and supplies down sampled signals to the digital processing circuits 12$c$L and 12$c$R for backward localization.

A digital processing circuit 12$c$L as signal processing means convolves an impulse response in which a transfer function HcL from the sound source SPc to the left ear of the listener M is transformed into the time axis into the digital audio signal SDc, and supplies a digital audio signal SDcL to an addition circuit 14L. Likewise, a digital processing circuit 12$c$R as signal processing means convolves an impulse response in which a transfer function HcR from the sound source SPc to the right ear of the listener M is transformed into the time axis into the digital audio signal SDc, and supplies a digital audio signal SDcR to an addition circuit 14R.

Also, an addition circuit 14$d$ subtracts the digital audio signal SDb from the digital audio signal SDa to generate a digital audio signal SDd for localization to the sound source SPd right backward, and supplies it to a decimation filter 11$d$. The decimation filter 11$d$ as sampling rate change means performs the down sampling for the digital audio signal SDd at 1/n the sampling rate, and supplies down sampled signals to the digital processing circuits 12$d$L and 12$d$R for backward localization.

A digital processing circuit 12$d$L as signal processing means convolves an impulse response in which a transfer function HdL from the sound source SPd to the left ear of the listener M is transformed into the time axis into the digital audio signal SDd, and supplies a digital audio signal SDdL to the addition circuit 14L. Likewise, a digital processing circuit 12$d$R as signal processing means convolves an impulse response in which a transfer function HdR from the sound source SPd to the right ear of the listener M is transformed into the time axis into the digital audio signal SDd, and supplies a digital audio signal SDdR to the addition circuit 14R.

Also, the addition circuit 14L adds the digital audio signals SDcL and SDdL to generate a digital audio signal SDrL that is a component from two sound sources SPc and SPd backward to the left ear, and supplies it to an interpolation filter 13L. The interpolation filter 13L performs the up sampling for the digital audio signal SDrL at n times the sampling rate, and supplies up-sampled signals to the addition circuit 7L for left channel.

Likewise, the addition circuit 14R adds the digital audio signals SDcR and SDdR to generate a digital audio signal SDrR that is a component from two sound sources SPc and SPd backward to the right ear, and supplies it to an interpolation filter 13R. The interpolation filter 13R performs the up sampling for the digital audio signal SDrR at n times the sampling rate, and supplies up-sampled signals to the addition circuit 7R for right channel.

And the addition circuit 7L adds the digital audio signals SDaL, SDbL and SDrL to generate a digital audio signal SDL on the left channel. Likewise, the addition circuit 7R adds the digital audio signals SDaR, SDbR and SDrR to generate a digital audio signal SDR on the right channel.

The digital analog conversion circuits 4L and 4R convert the digital audio signals SDL and SDR into analog form to generate the analog audio signals SAL and SAR, which are amplified by the corresponding amplifiers 5L and 5R, and supplied to the headphone 6. And the acoustic units 6L and 6R of the headphone 6 convert the analog audio signals SAL and ASR into sound and output it.

At this time, the left and right reproduced sounds outputted from the headphone 6 compose the almost same sound field as the speakers placed in the sound sources SPa to SPd as shown in FIG. 14, in which each sound image of reproduced sound is auditorily localized of the listener M.

(2-2) Reducing the Arithmetical Operation in the Headphone Apparatus

Each of the digital processing circuits 12$c$L, 12$c$R, 12$d$L and 12$d$R for backward localization operate at 1/n the sampling rate of the digital processing circuits 12$a$L, 12$a$R, 12$b$L and 12$b$R for forward localization.

Therefore, the headphone apparatus 20, like the headphone apparatus 10 of the first embodiment, can reduce the amount of operation in the digital processing circuits 12$c$L, 12$c$R, 12$d$L and 12$d$R for backward localization into $1/n^2$ as compared with when no down sampling is performed. And each of the decimation filters 11$c$ and 11$d$ for down sampling and the interpolation filters 13L and 13R for up sampling is made up of an IIR filter, in which the amount of operation is so small as to be ignorable.

With the above configuration, the digital processing circuits 12$c$L, 12$c$R, 12$d$L and 12$d$R for backward localization are operated at 1/n the sampling rate, whereby the configuration of the headphone apparatus 20 is simplified by reducing the amount of operation without spoiling the spatial localization of the sound image.

(3) Third Embodiment

While in the headphone apparatus 20 of the second embodiment, the audio signals SAc and SAd for backward localization are generated from the input audio signals SAa and SAb, when the positions of the sound sources SPc and SPd for localizing the audio signals SAc and SAd for backward localization (FIG. 14) are bilateral to a median plane of the head part of the listener M, the digital processing circuits for backward localization (12$c$L, 12$c$R, 12$d$L and 12$d$R as shown in FIG. 13) can be further simplified.

That is, in FIG. 13, the digital audio signal SDrL supplied from the interpolation filter 13L to the addition circuit 7L for left channel is given by the following expression.

$$\begin{aligned} SDrL &= SDcL + SDdL \\ &= SDc \times HcL + SDd \times HdL \\ &= (SDb - SDa)HcL + (SDa - SDb)HdL \\ &= (SDa - SDb) \times (HdL - HcL) \end{aligned} \tag{3}$$

On the other hand, the digital audio signal SDrR supplied from the interpolation filter 13R to the addition circuit 7R for right channel is given by the following expression.

$$\begin{aligned} SDrR &= SDcR + SDdR \\ &= SDc \times HcR + SDd \times HdR \\ &= (SDb - SDa)HcR + (SDa - SDb)HdR \\ &= (SDb - SDa) \times (HcR - HdR) \end{aligned} \tag{4}$$

Herein, when the positions of the sound sources SPc and SPd are bilateral to the median plane of the head part of the listener M, HcL=HdR and HcR=HdL, whereby the digital audio signals SDrL and SDrR are given by the following expressions (5) and (6).

$$SDrL = (SDa - SDb) \times (HdL - HcL) = (SDa - SDb) \times (HcR - HcL) \quad (5)$$

$$SDrR = (SDb - SDa) \times (HcR - HdR) = (SDb - SDa) \times (HcR - HcL) \quad (6)$$

Since all the transfer functions in the expressions (5) and (6) are (HcR−HcL), supposing Hz=HcR−HcL and SDz=SDb−SDa, the digital audio signals SDrL and SDrR are given by the following expressions (7) and (8).

$$SDrL = (SDa - SDb) \times (HdL - HcL) = -SDz \times Hz \quad (7)$$

$$SDrR = (SDb - SDa) \times (HcR - HcL) = SDz \times Hz \quad (8)$$

Therefore, the digital audio signal SDrR is generated by inverting the digital audio signal SDrL, whereby the digital audio signals SDrL and SDrR can be generated from one digital processing circuit.

Figure 15:
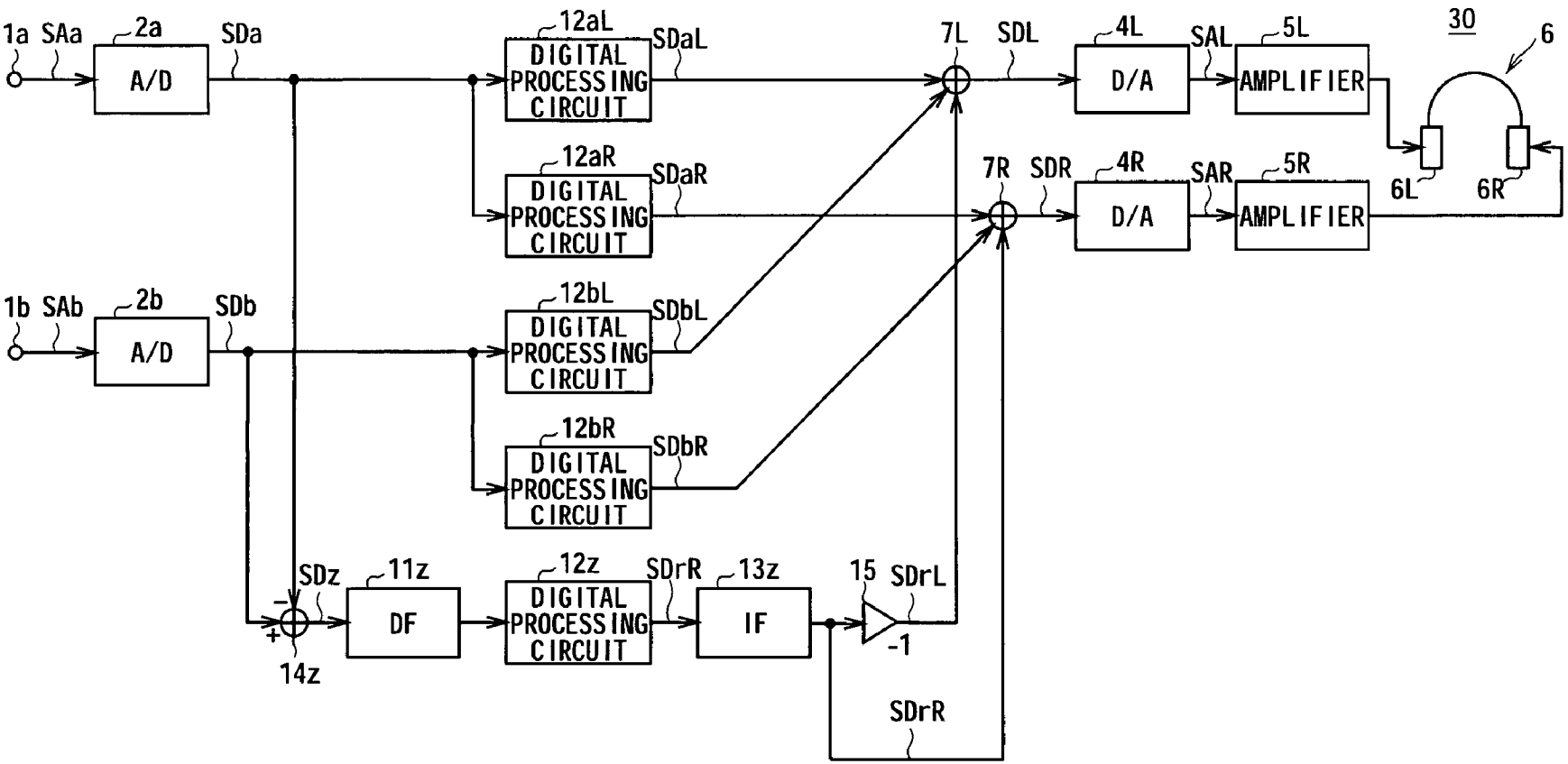
FIG. 15 is a block diagram showing the overall configuration of a headphone apparatus according to a third embodiment of the invention.

In FIG. 15, wherein the common parts to those of FIG. 13 are designated by the same signs, reference numeral 30 designates a headphone apparatus as a sound image localization apparatus according to a third embodiment of the invention, in which the processes for the analog digital conversion circuits 2*a* and 2*b* and the digital processing circuits 12*a*L, 12*a*R, 12*b*L, 12*b*R are the same as those for the headphone 20 as shown in FIG. 13, and the explanation of those circuits is omitted.

An addition circuit 14*z*subtracts the digital audio signal SDa from the digital audio signal SDb to generate a digital audio signal SDz, which is supplied to a decimation filter 11*z*. The decimation filter 11*z* as sampling rate change means performs the down sampling for the digital audio signal SDz at 1/n the sampling rate (n is an integer of 2 or greater), and supplies down sampled signals to a digital processing circuit 12*z* for backward localization.

The digital processing circuit 12*z* as signal processing means convolves an impulse response in which a transfer function Hz (=HcR−HcL) is transformed into the time axis into the digital audio signal SDz, and supplies a digital audio signal SDrR right backward to an interpolation filter 13*z*. The interpolation filter 13*z* performs the up sampling for the digital audio signal SDrR at n times the sampling rate, and supplies up-sampled signals to the addition circuit 7R for right channel and an inversion circuit 15. The inversion circuit 15 inverts the digital audio signal SDrR to generate a digital audio signal SDrL left backward and supplies it to the addition circuit 7L for left channel.

And the addition circuit 7L adds the digital audio signals SDaL, SDbL and SDrL to generate a digital audio signal SDL on the left channel. Likewise, the addition circuit 7R adds the digital audio signals SDaR, SDbR and SDrR to generate a digital audio signal SDR on the right channel.

The digital analog conversion circuits 4L and 4R convert the digital audio signals SDL and SDR into analog form to generate the analog audio signals SAL and SAR, which are amplified by the corresponding amplifiers 5L and 5R, and supplied to the headphone 6. And the acoustic units 6L and 6R of the headphone 6 convert the analog audio signals SAL and SAR into sound and output it.

At this time, the left and right reproduced sounds outputted from the headphone 6 compose the almost same sound field as the speakers placed in the sound sources SPa to SPd as shown in FIG. 14, in which each sound image of reproduced sounds is auditorily localized of the listener M.

In this headphone apparatus 30, one digital processing circuit 12*z* performs the equivalent processes of four digital processing circuits 12*c*L, 12*c*R, 12*d*L and 12*d*R as signal processing means in the headphone apparatus 20 of the second embodiment, whereby the configuration of the headphone apparatus 30 is simplified by greatly reducing the amount of operation without spoiling the spatial localization of the sound image.

(4) Other Embodiments

Figure 6:
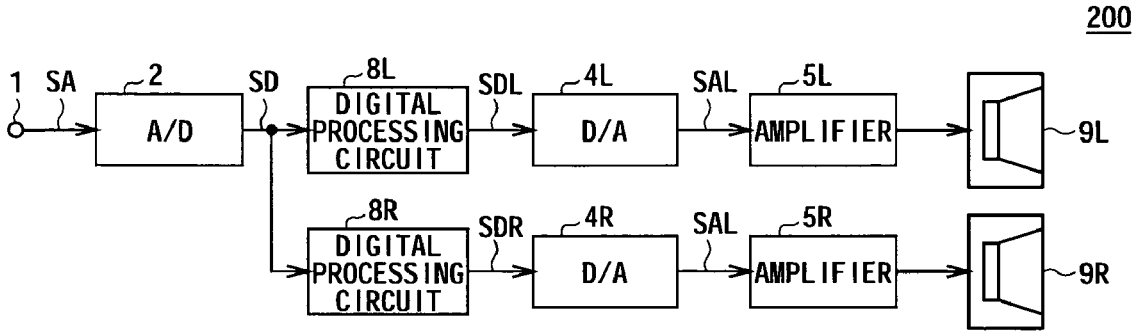
FIG.6(RELATED ART)
FIG. 6 is a block diagram showing the overall configuration of a conventional speaker apparatus.
Figure 7:
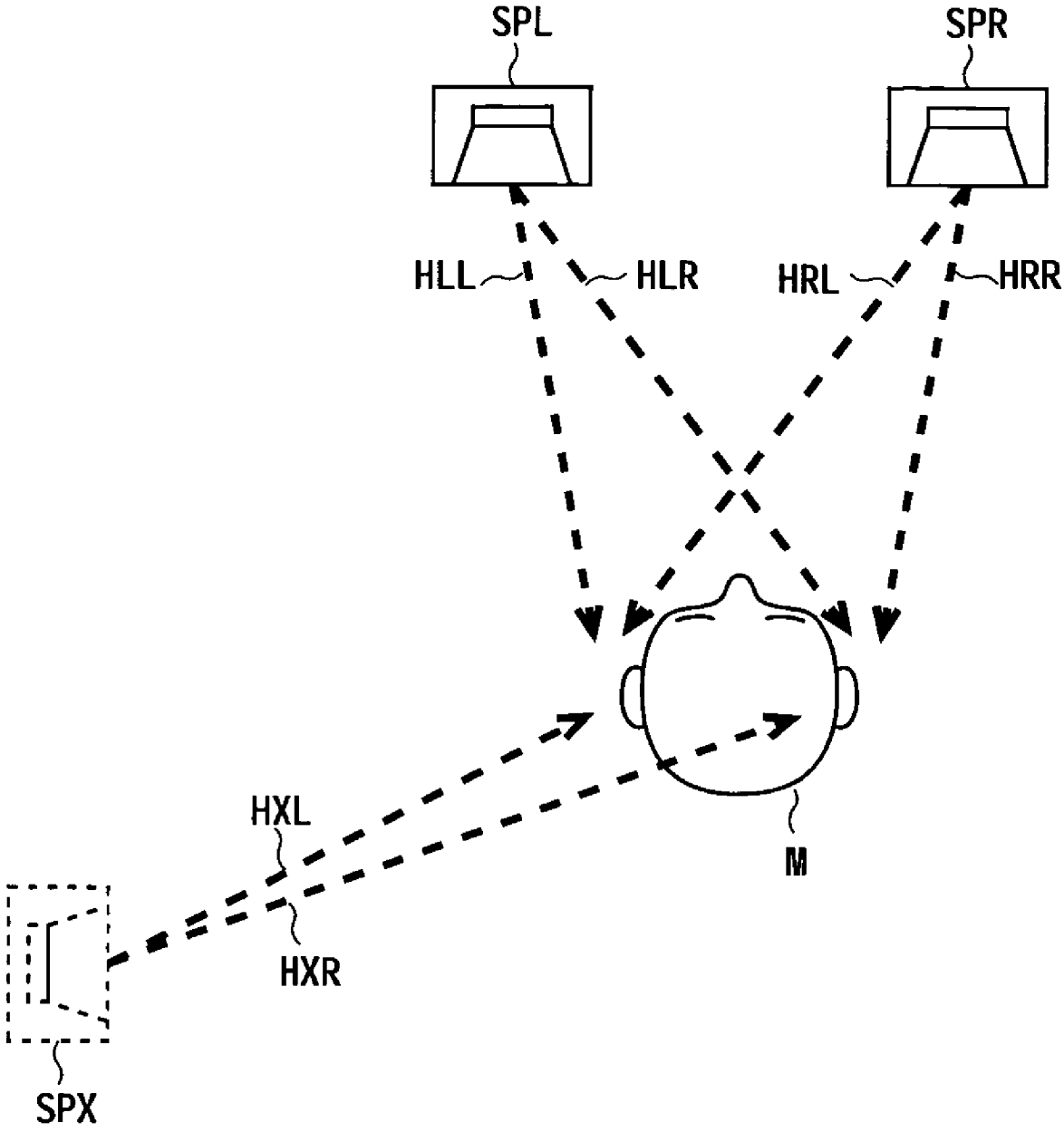
FIG.7(RELATED ART)
FIG. 7 is a diagrammatic view for explaining the transfer functions in the speaker apparatus.

While in the first to third embodiments, this invention is applied to the headphone apparatus for auditorily localizing the sound image, this invention is not limited to those embodiments, but may be also applied to a speaker apparatus for localizing the sound image to any position, as shown in FIG. 6.

While in the first to third embodiments, the down sampling is performed at 1/n (n is an integer of 2 or greater) the sampling frequency of the digital processing circuit for backward localization, this invention is not limited thereto, but the down sampling may be made at 1/m (m is a real number) the sampling frequency of the digital processing circuit for backward localization.

Also, while in the second embodiment, a digital audio signal SDc for localization to the sound source SPc is generated by subtracting the digital audio signal SDa from the digital audio signal SDb, a digital audio signal SDd for localization to the sound source SPd is generated by subtracting the digital audio signal SDb from the digital audio signal SDa, and an impulse response is convoluted after down sampling the digital audio signal SDc and the digital audio signal SDd, this invention is not limited thereto, but a digital audio signal SDd may be generated by inverting a digital audio signal SDc, and an impulse response may be convoluted after down sampling the digital audio signal SDc and the digital audio signal SDd. Moreover, the digital audio signal SDc may be down sampled and inverted, and an impulse response may be convoluted into the inverted signal as the digital audio signal SDd after down sampling. Thereby, the overall amount of operation in the headphone apparatus 20 can be further reduced.

Further, while in the second and third embodiments, the audio signal for backward localization is generated by adding or subtracting plural input audio signals, this invention is not limited thereto, but the audio signal for backward localization may be generated by various methods, including making a part of the input audio signal with an extracted bandwidth the audio signal for backward localization.

Moreover, while in the first to third embodiments, a series of signal processings including down sampling the audio signal for backward localization, convolution of impulse response and up sampling are performed by hardware, such as decimation filter, digital processing circuits and interpolation filter, this invention is not limited thereto, but a series of processings for localizing the sound image may be performed by a signal processing program that is executed on the information processing means such as Digital Signal Processor (DSP).

Figure 16:
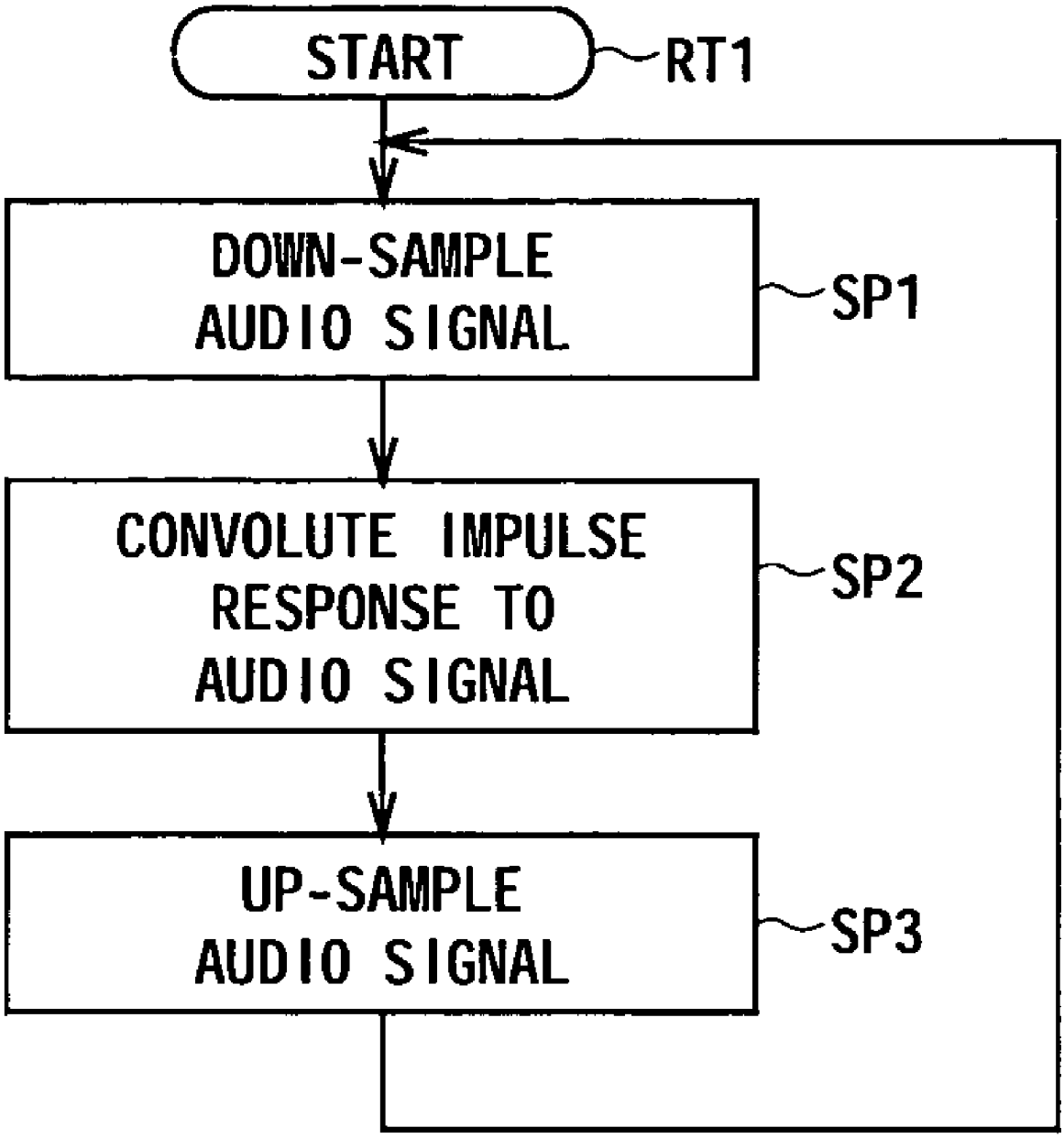
FIG. 16 is a flowchart of a signal processing procedure for localizing the audio signal backward.

Referring to a flowchart of FIG. 16, a sound image localization processing program for performing such processings will be described below. The information processing means of the headphone apparatus enters a start step of a sound image localization processing procedure routine RT1 and proceeds to step SP1 of down sampling the digital audio signal for backward localization. Then, the procedure goes to the next step SP2.

At step SP2, the information processing means of the headphone apparatus convolutes an impulse response in which the transfer function measured or calculated in advance is transformed into the time axis into the digital audio signal after down sampling. Then, the procedure goes to the next step SP3. At step SP3, the information processing means of the headphone apparatus up-samples the digital audio signal after convoluting the impulse response to restore the original sampling rate, and outputs up-sampled audio signals to the addition circuit (not shown) at the latter stage. Then, the procedure returns to step SP1.

In this manner, even when the signal processing for the audio signal for backward localization is performed by the sound image localization processing program, the impulse response is convoluted after down sampling the audio signal for backward localization, whereby the information processing means has a lower processing load.

This signal processing program may be stored or distributed in a recording medium such as CD-ROM, DVD, or semiconductor memory, and executed on the personal computer employed by the listener or the signal processing apparatus. Of course, this signal processing program may be down-loaded via a network into the personal computer.

This invention is applicable to the purpose for localizing the sound image of audio signal to any position.

It should be understood by those skilled in the art that various modifications, combinations, sub-combinations and alterations may occur depending on design requirements and other factors insofar as they are within the scope of the appended claims or the equivalents thereof.

What is claimed is:

1. A sound image localization apparatus for localizing a reproduced sound image at a position of a sound source by generating an audio signal on left and right channels that is based on impulse responses from the position of the sound source to left and right ears of a listener, said sound image localization apparatus comprising:

first analog-to-digital conversion means for converting an analog front audio signal, localized to a position of the sound source that is in front of the listener, to a digital localized front audio signal;

second analog-to-digital conversion means for converting an analog rear audio signal, localized to a position of the sound source that is behind the listener, to a digital localized rear audio signal;

sampling rate change means for down sampling the digital localized rear audio signal to have a sampling rate that is 1/n a sampling rate of the digital localized front audio signal, wherein n is an integer having a value of 2 or greater, thereby removing higher frequency portions of impulse responses from the position of the sound source behind the listener to the left and right ears of the listener;

first signal processing means for performing signal processing for the digital localized front audio signal based on impulse responses from the position of the sound source in front of the listener to the left and right ears of the listener; and second signal processing means for performing signal processing for the down sampled rear audio signal based on the impulse responses from the position of the sound source behind the listener to the left and right ears of the listener having the higher frequency portions removed.

2. The sound image localization apparatus according to claim 1, further comprising rear audio signal generation means for generating said rear audio signal from an input audio signal.

3. The sound image localization apparatus according to claim 2, wherein:

said rear audio signal generation means generates a plurality of rear audio signals for localizing the sound image at different positions of the sound source behind the listener from a plurality of said input audio signals; and said signal processing means performs the signal processing for each of said plurality of rear audio signals after down sampling based on the corresponding impulse responses to generate said audio signal for localization.

4. The sound image localization apparatus according to claim 2, wherein said signal processing means performs the signal processing for said rear audio signal after down sampling based on impulse responses from a first position of localization of the sound source behind the listener to the left and right ears of the listener to generate a first audio signal for localization where the sound image is localized at said first position of localization of the sound source, and generate a second audio signal for localization where the sound image is localized at a second position of localization of the sound source in contrast to said first position of localization of the sound source via a median plane of the listener's head by inverting said first audio signal for localization.

5. A sound image localization method for localizing a sound image at a position of a sound source by generating an audio signal on left and right channels that is based on impulse responses from the position of the sound source to left and right ears of a listener, said sound image localization method comprising:

a first analog-to-digital conversion step of converting an analog front audio signal, localized to a position of the sound source that is in front of the listener, to a digital localized front audio signal;

a second analog-to-digital conversion step of converting an analog rear audio signal, localized to a position of the sound source that is behind the listener, to a digital localized rear audio signal;

a sampling rate conversion step of down sampling the digital localized rear audio signal to have a sampling rate that is 1/n a sampling rate of the digital localized front audio signal, wherein n is an integer having a value of 2 or greater, thereby removing higher frequency portions of impulse responses from the position of the sound source behind the listener to the left and right ears of the listener;

a first signal processing step of performing signal processing for the digital localized front audio signal based on impulse responses from the position of the sound source in front of the listener to the left and right ears of the listener; and a second signal processing step of performing signal processing for the down sampled rear audio signal based on the impulse responses from said the position of the sound source behind the listener to the left and right ears of the listener having the higher frequency portions removed.

6. A program recording medium having recorded thereon a sound image localization program for carrying out a method of localizing a sound image at a position of a sound source by generating an audio signal on left and right channels that is based on impulse responses from the position of the sound source to left and right ears of a listener, said sound image localization method comprising:

a first analog-to-digital conversion step of converting an analog front audio signal, localized to a position of the sound source that is in front of the listener, to a digital localized front audio signal;

a second analog-to-digital conversion step of converting an analog rear audio signal, localized to a position of the sound source that is behind the listener, to a digital localized rear audio signal;

a sampling rate conversion step of down sampling the digital localized rear audio signal to have a sampling rate that is 1/n a sampling rate of the digital localized front audio signal, wherein n is an integer having a value of 2 or greater, thereby removing higher frequency portions of impulse responses from the position of the sound source behind the listener to the left and right ears of the listener;

a first signal processing step of performing signal processing for the digital localized front audio signal based on impulse responses from the position of the sound source in front of the listener to the left and right ears of the listener; and a second signal processing step of performing signal processing for the down sampled rear audio signal based on the impulse responses from said the position of the sound source behind the listener to the left and right ears of the listener having the higher frequency portions removed.

* * * * *